United States Patent [19]

Topel

[11] 4,136,462

[45] Jan. 30, 1979

[54] ADJUSTABLE CROSSHAIR SIGHT FOR ARCHERY BOW

[76] Inventor: Kenneth D. Topel, 11209 Shaw Rd. E., Puyallup, Wash. 98371

[21] Appl. No.: 859,432

[22] Filed: Dec. 12, 1977

[51] Int. Cl.[2] ..... F41G 1/46

[52] U.S. Cl. ..... 33/265

[58] Field of Search ..... 33/265, 298; 124/87

[56] References Cited

U.S. PATENT DOCUMENTS

| | | | |
|---|---|---|---|
| 3,136,063 | 6/1964 | Stebbins | 33/265 |
| 3,455,027 | 7/1969 | Perkins | 33/265 |
| 3,670,422 | 6/1972 | Stebbins et al. | 33/265 |

*Primary Examiner*—Richard R. Stearns
*Attorney, Agent, or Firm*—Christensen, O'Connor, Johnson & Kindess

[57] ABSTRACT

An adjustable crosshair sight for archery bows comprises a frame in which a plurlity of horizontal wires are mounted in parallel spaced relation such that the vertical distance between adjacent wires can be varied. A vertical wire is mounted in the frame bisecting the horizontal wires, thereby forming a series of vertically spaced crosshairs within the frame. The horizontal wires provide a series of range references to the archer while the vertical wire provides a windage reference. The frame is movably mounted on the bow such that the crosshairs are in the line of sight of the archer when he is in position to shoot and the horizontal distance between the frame and the bow can be adjusted, thereby varying the distance between the vertical wire and the bow and providing a sideways or windage adjustment in the sight.

8 Claims, 5 Drawing Figures

ADJUSTABLE CROSSHAIR SIGHT FOR ARCHERY BOW

BACKGROUND OF THE INVENTION

This invention relates to sights for archery bows and, more particularly, to hunting sights having adjustable crosshairs.

Sights have long been known for use with archery bows. One of the earliest sights comprised a stick or rod extending horizontally from the bow in the line of sight of the archer when the archer was in a position to shoot. The vertical height of the stick or rod was adjustable to allow for the particular range or distance to the target. The archer would draw the bowstring back and align the end of the stick with a point on the target. If the arrow missed the target the position of the stick on the bow could be adjusted until the proper position was found by trial and error.

A more sophisticated sight has been developed which replaces the stick with a threaded shaft having a ball on one end. A mounting block is attached to the bow and the threaded shaft is turned into a bore in the mounting block so that the ball end is in the line of sight of the archer. The mounting block is slidably mounted on the bow for vertical movement to provide a range adjustment in the sight. As well as moving along its flight path, an arrow tends to move transversely to its flight path, a movement known as windage. The amount of windage varies with wind conditions and also with different types of arrows. To compensate for this transverse movement and to provide a windage adjustment in the sight, the threaded shaft previously described can be turned into or out of the mounting block to move the ball end right or left.

Even with more sophisticated sight described above, the proper position of the sight on the bow is still a trial and error process. In target shooting, where the range of the target is known, it is possible to set the sight in position and leave it at that position during the entire shooting session. However, if the archer is hunting wild game, there is an added variable in that each game animal sighted will be at a varying range from the bow. There is not sufficient time while hunting to make adjustments in the sight each time a different animal comes into view.

One method of solving this problem is to provide a number of threaded shafts with ball ends vertically spaced from each other on the bow. Each of the shafts can be preset for a certain range. When the hunter sees the target animal and estimates its range, the proper pin can be used to sight the target. The disadvantage of this method is that each pin must be individually adjusted for windage. There is also no accurate sight provided for a range between two range pin balls.

Another disadvantage of the prior art sight is that the threaded shaft, once loosened for a range adjustment, is also free to move slightly in the direction of the windage adjustment, and vice versa, so that it is in practice nearly impossible to adjust range or windage separately, one from the other.

The prior art archery sights used in hunting have used a ball at the end of a shaft as the means with which the hunter draws a bead on the target. As evidenced by their widespread use in rifle sights, it would be desirable to use a crosshair as the sighting means in a bow sight.

It is therefore an object of this invention to provide an improved bow sight which is suitable for a hunting environment.

It is a further object of this invention to provide a bow sight which is adjustable to several ranges and which allows adjustment in either windage or range independently one from the other.

It is another object of this invention to provide a bow sight which provides a single windage adjustment for all ranges simultaneously.

It is a still further object of this invention to provide a bow sight which utilizes crosshairs as the sighting element.

SUMMARY OF THE INVENTION

In accordance with the principles of the present invention, a new and improved sight for use on archery bows is provided. The sight is particularly useful in a game hunting environment.

The sight of this invention comprises a plurality of first wires mounted in parallel spaced relation in a frame. The first wires serve as the range references of the sight. A windage reference is provided by a second wire mounted in the frame such that it is generally orthogonal to and intersects the horizontal wires to form a series of vertically spaced crosses or crosshairs. Means are provided for mounting the frame containing the crosshairs on the bow generally in the line of sight of an archer holding the bow in a position to shoot an arrow from the bow.

In a further embodiment of the sight, the position of each horizontal wire can be adjusted to provide a range adjustment to the sight.

In still a further embodiment of the sight of the present invention, the frame is mounted on the bow so that the position of the entire frame assembly can be adjusted laterally in relation to the bow, thereby changing the position of the second wire in relation to the bow and providing a windage adjustment to the sight. Since the second wire is continuous, the windage adjustment of all the ranges is accomplished simultaneously. The continuous nature of the second wire also permits its use as a reference line on which the archer can focus when sighting between two adjacent crosshairs.

BRIEF DESCRIPTION OF THE DRAWINGS

The objects and advantages of the present invention will be more easily appreciated and a further understanding of the invention will be gained by reading the detailed description provided below when taken in conjunction with the attached drawings, wherein.

DETAILED DESCRIPTION OF A PREFERRED EMBODIMENT

Figure 1:
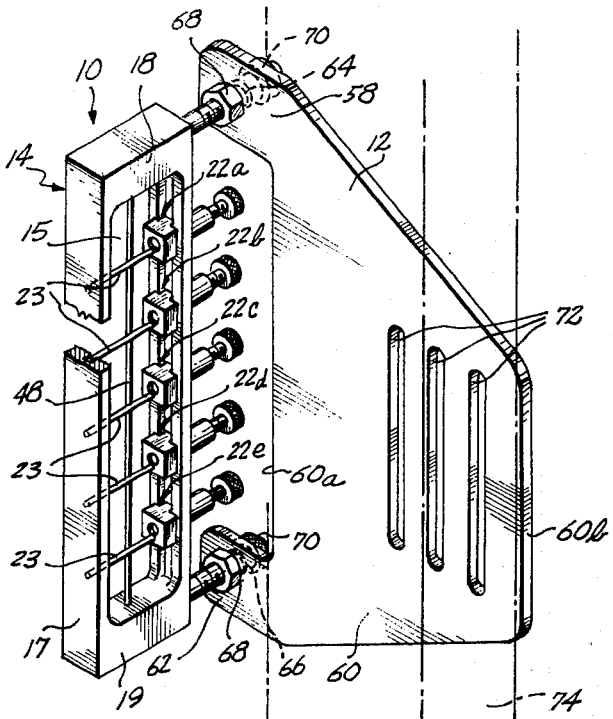
FIG. 1 is an isometric view of an archery sight formed in accordance with the principles of the present invention.
Figure 2:
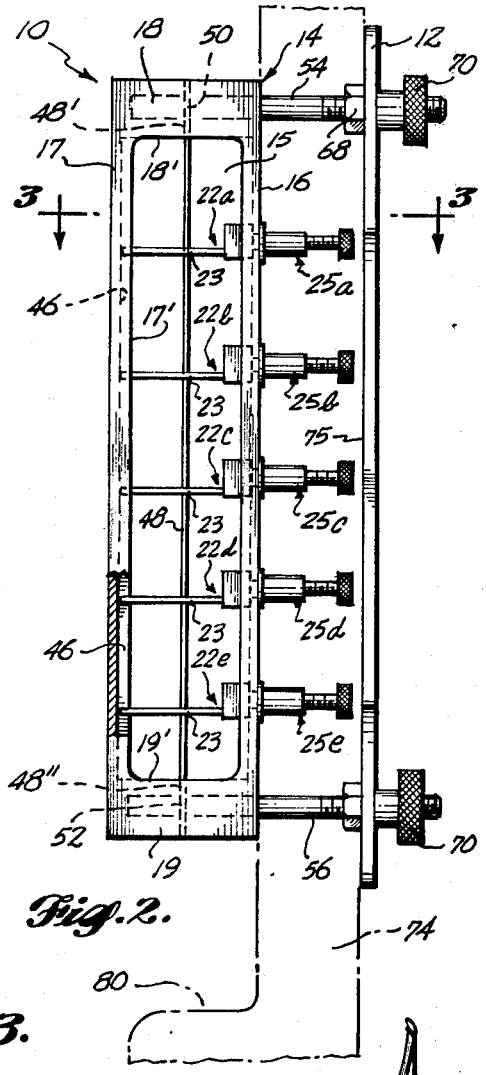
FIG. 2 is an end view of the sight shown in FIG. 1 as seen by the archer in position to shoot.

FIG. 1 shows an archery sight constructed in accordance with the principles of this invention. The sight, generally denoted as 10, comprises a mounting plate 12 movably attached to a crosshair frame 14. The crosshair frame 14 is generally rectangular in shape and includes two elongate side walls 16 and 17, an elongate top wall 18 and an elongate bottom wall 19. The side walls 16 and 17 are of the same length and are longer than top wall 18 and bottom wall 19. The walls 16, 17, 18 and 19 border a rectangular aperture 15. A crosshair mounting slot 20 is formed in the side wall 16. The slot 20 extends the length of the elongate dimension of the side wall 16 and extends through the side wall 16 such that the slot 20 opens into the aperture 15. A plurality of horizontal wire assemblies **22*a*, 22*b*, 22*c*, 22*d*, 22*e* are mounted on the frame 14 in parallel spaced relation extending across the rectangular aperture 15 to provide the horizontal members of the sight crosshairs 23. The construction and mounting of each of the wire assemblies 22*a*–22*e* is identical and therefore only the topmost wire assembly 22*a* will be described as representative of the other wire assemblies 22*b*–22*e***.

Figure 3:
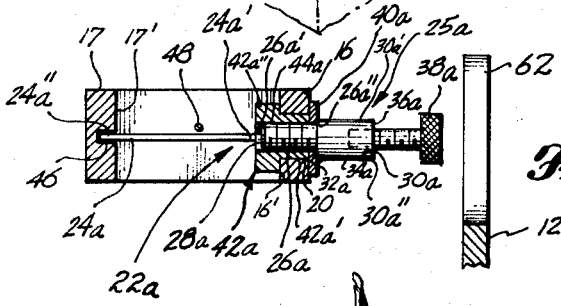
FIG. 3 is a plan view in cross section along line 3—3 in FIG. 2.

FIG. 3 illustrates the mounting and construction of the wire assembly **22*a*. A T-nut) a has a shank portion 42*a* ' crossbar portion 42*a*'' perpendicular to the shank portion 42*a*' such that the nut is in the shape of the letter "T". A threaded hole 44a is formed in the end of the shank portion 42*a*' furthest from the crossbar portion 42*a*'' and extends through shank portion 42*a*' and the crossbar portion 42*a*'' perpendicular to the crossbar portion 42*a*''. The shank portion 42*a*' of the T-nut 42*a* is inserted into the slot 20 such that the crossbar portion 42*a*'' abuts an interior surface 16' of the side wall 16 which defines in part the aperture 15. The crossbar portion 42*a*'' is of a size large enough to prevent it from entering the slot 20. A wire 24*a* extends from the non-abutting surface of the crossbar portion 42*a*'' across the rectangular aperture 15 to the side wall 17. The wire 24*a* has a first end 24*a*'' which is press fit into a hole 28*a* formed in the crossbar portion 42*a*'' of the T-nut 42*a*. The hole 28*a* is parallel to the hole 44*a* and spaced from it in line with the slot 20. The wire 24*a*** should be strong enough to support its own weight with no sag when the wire is in a horizontal position. A preferred wire is a 0.032 inch diameter piano wire.

The T-nut **42*a* and wire 24*a* are held in place by a mounting shaft assembly 25*a*. The mounting shaft assembly 25*a* includes a threaded cylindrical shaft 26*a* having a first end 26*a*' which threadably engages the threaded hole 44*a* in the T-nut 42*a*. A second end 26*a*'' of the shaft 26*a* is attached to a cylindrical bushing 30*a* by turning the threaded shaft 26*a* into a threaded hole 32*a* formed in a first end 30*a*' of the bushing 30*a*. The cylindrical axes of the shaft 26*a* and bushing 30*a* are colinear. The outer surface 34*a* of the bushing 30*a* is preferably knurled, for reasons which will be discussed below. A second threaded hole 36*a* is formed in the second end 30*a*'' of the bushing 30*a*. An Allen head machine screw 38*a* is turned into hole 36*a*. The purpose of the machine screw will be disclosed below. The component parts of the mounting shaft assembly 25*a* are rigidly connected so that when one part, for example the bushing 30*a*, is turned, the entire assembly turns. As shaft 26*a* is thereafter turned, the side wall 16 is clamped between the crossbar portion 42*a*'' and the first end 30*a*' of the bushing 30*a*. A washer 40*a* having an outer diameter larger than the width of the slot 20 may be interposed between the side wall 16*a* and the bushing 30*a* to prevent the bushing 30*a* from entering the slot 20**.

A groove 46 is formed in an interior surface 17' of side wall 17 which defines in part the aperture 15. The groove 46 extends the length of side wall 17 and is of sufficient width to closely receive the second end **24*a*'' of wire 24*a***.

When it is desired to change the position of wire assembly **22*a*, the bushing 30*a* is gripped and rotated to unthread the shaft 26*a* from the T-nut 42*a* and to thereby unclamp the side wall 16. The wire assembly 22*a* is then free to slide along the extensions of slot 20 and groove 46. When the desired position of the wire assembly 22*a* is reached, the busing 30*a* is rotated to thread the T-nut 42*a* onto the shaft 26*a* to again clamp the side wall 16. When the archer has confirmed that the wire assembly 22*a* is in the desired location, the assembly can be further tightened by using an Allen wrench to turn the Allen head machine screw 38*a***.

Several variations can be made in the construction and mounting of the wire assembly **22*a* while remaining within the scope of the present invention. For example, the head of machine screw 38*a* could be slotted to coact with a conventional screwdriver or have a hex head to coact with a wrench. Also, the machine screw 38*a* could be replaced with a nonthreaded shaft which is pressfit into the bushing 30*a* rather than being threadably engaged therein. Further, the mounting shaft assembly 25*a*, rather than being comprised of separate elements such as bushing 30*a*, shaft 24*a* and machine screw 38*a*, could be integrally machined from a single piece of stock. The only requirement of the mounting shaft assembly 25*a* is that it be rigidly constructed so that, when any part of the mounting shaft assembly is turned, the entire mounting shaft assembly turns. Also the wire 24*a* could be affixed to the first end 26*a* ' so that it passes through the hole 44*a* and across the aperture 15. It is preferable however to mount the wire 24*a* on the T-nut 42*a* as described. If the wire is mounted on the shaft 26*a* a spacing of at least the width of the T-nut 42*a*** will always remain between adjacent wires. By mounting the wire on the T-nut near the edge of the T-nut it is possible to obtain a much closer spacing of adjacent wires and therefore a much narrower gap between ranges as referenced by adjacent wires.

As was previously mentioned, each of the wire assemblies **22*a*, 22*b*, 22*c*, 22*d*, 22*e* is constructed and mounted in frame 14 identically to the above-described wire assembly 22*a***. Although the illustrated embodiment shows five wire assemblies, a greater or lesser number can be used, as desired.

The vertical element of the sight crosshairs 23 is formed by the intersection of the wires **24*a*, 24*b*, 24*c*, 24*d*, 24*e* with a vertical wire 48 mounted within the frame 14. A first end 48' of the wire 48 is inserted into a hole 50 formed in an interior surface 18' of the top wall 18 defining in part the aperture 15 and located such that the vertical wire 48 bisects the rectangular aperture 15 along its longer dimension. A second end 48'' of the wire 48 is inserted into a hole 52 formed in an interior surface 19' and opposite hole 50. The ends of the vertical wire 48 are fastened in the holes 50 and 52** by suitable means, such as a spot weld or glue.

The crosshair frame 14 is attached to the mounting plate 12 so that the distance between the frame 14 and the mounting plate 12 can be varied. The crosshair frame 14 has two threaded rods projecting from it. A first threaded rod 54 is located near one end of side wall 16 and extends downwardly from side wall 16 parallel to the top wall 18. A second threaded rod 56 is located at the other end of side wall 16 and extends outwardly from the side wall 16 parallel to the bottom wall 19. The threaded rods 54 and 56 provide the connecting link between frame 14 and the mounting plate 12. The mounting plate 12 comprises a generally trapezoidal portion 60 having a longer side 60*a* and an opposed, shorter side 60*b*, and first and second tab portions 58, 62 respectively, extending from opposed ends of larger side 60*a*. The tab portions 58, 62 have apertures 64, 66 respectively therethrough normal to the plane of mounting plate 12. Each of the rods 54 and 56 is inserted through its associated aperture 64, 66. A backing nut 68 and a knurled nut 70 are threaded onto each rod 54, 56 such that the respective tab portions 58 and 62 are interposed between the associated backing nut 68 and knurled nut 70. The position of the backing nut 68 and the knurled nut 70 on the rods 54, 56 determine the spacing of the frame 14 relative to the mounting plate 12. The spacing can be changed by turning the two pairs of nuts 68, 70 further onto the rods 54, 56 toward the frame 14 or by backing the nuts off away from the frame 14.

Figure 4:
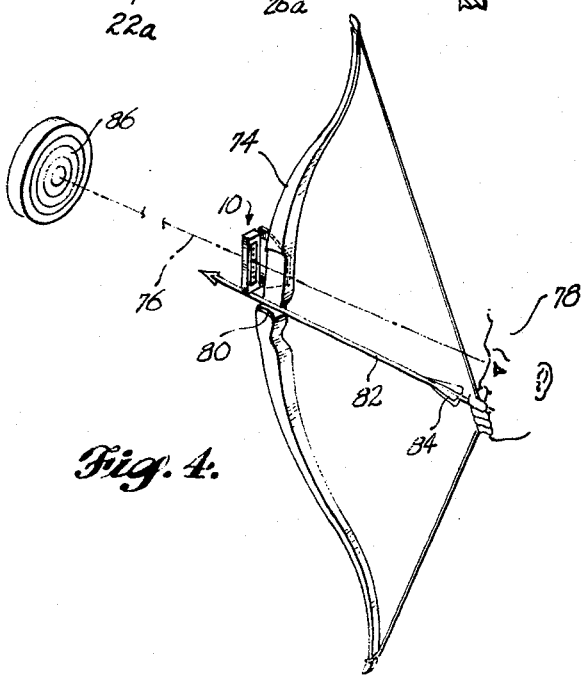
FIG. 4 is a pictorial view of a sight made in accordance with the principles of this invention in use on a bow.
Figure 5:
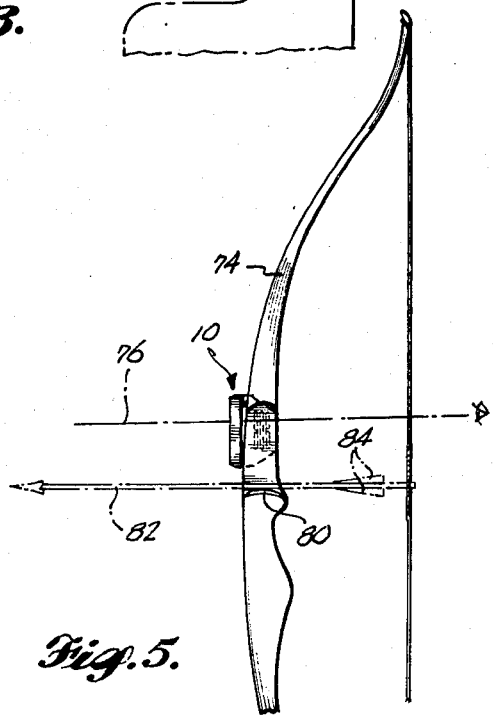
FIG. 5 is a side elevation view of the sight of FIG. 1 mounted on a bow.

The mounting plate 12 has three elongate slots 72 formed through the trapezoidal portion 60 in spaced relation and parallel to the opposed sides 60*a*, 60*b*. In assembly with a bow 74, the surface of the mounting plate 12 facing the frame 14 abuts the side of the bow 74. Screws (not shown) are inserted through slots 72 and are turned into the bow 74 to secure the sight 10 of the bow 74. The sight 10 is mounted on the bow 74 so that the crosshairs 23 are in a line of sight 76 of the archer 78 when the archer is in a position to shoot. FIGS. 4 and 5 show a sight 10 made in accordance with the principles of this invention mounted on a bow 74. The sight 10 is located above an arrow rest 80 on the bow 74 a distance sufficient to allow the arrow 82 to pass beneath the bottom wall 19 of the frame 14 without having the arrow feathers 84 come into contact with the bottom wall 19. In the case of a right handed archer, the mounting plate 12 is secured to the right side of the bow 74, as viewed by an archer 78 holding the bow 74 in position to shoot. As viewed along the line of sight 76, the bow appears interposed between the mounting plate 12 and the frame 14. The frame 14 is forward of the bow 74, that is, toward the target. If the archer 78 is left handed, the sight 10 is inverted and the mounting plate 12 is fastened to the left side of the bow 74.

In operation, the archer 78 places one of the crosshairs 23 in the line of sight 76 to a target 86. The crosshair 123 is visually placed on a desired spot on the target 86. The arrow 82 is released from the bow 74 toward the target 86. If the arrow misses the target because of an error in range, the archer can adjust the range of the sight by loosening the proper one of the wire assemblies 22*a*, 22*b*, 22*c*, 22*d*, or 22*e* and moving it up or down within the slot 20. The vertical positions of the wire assemblies 22*a*–22*e* are determined for various ranges by a trial and error process. Once the wire assemblies are set for the desired ranges, they can be used at those ranges for an indefinite period. The wire assemblies 22*a*–22*e* can be moved for use at a different range at a later time if desired or can be adjusted to compensate for wear in the arrow rest 80, for example. As previously mentioned, an arrow in flight tends to move transversely to its line of flight and therefore a windage adjustement is required. The sight 10 can be adjusted for windage by changing the lateral position of the frame 14 relative to the bow 74, thereby changing the relative position of the vertical wire 48 with respect to the bow 74. The vertical wire 48 serves as a horizontal reference point along its entire length and since a single vertical wire 48 is used as the vertical elemment of all the crosshairs 23, the windage adjustment of all the crosshairs 23 is accomplished simultaneously by the movement of frame 14. If the desired target is not at a range which is referenced by one of the crosshairs 23, the archer can extapolate the range by sighting along vertical wire 48 between two adjacent crosshairs. Since wire 48 is continuous, it provides a windage reference between crosshairs as well as at the crosshair intersections themselves.

In summary, an archery sight is disclosed which uses a plurality of vertically spaced crosshairs as the sighting element. The crosshairs are individually adjustable for range and the plurality of crosshairs allows several ranges to be set into the sight simultaneously, thereby making the sight useful in a hunting environment in which the target is not located at a predetermined range. A single continuous vertical wire is used as the vertical element of all the crosshairs therefore a change in the horizontal position of the vertical crosshair in relation to the bow to adjust for windage adjusts the windage of all the crosshairs simultaneously. The continuous vertical wire also provides a reference point which can be used when sighting to a range between two adjacent, preset crosshairs.

While the invention has been described with respect to a preferred embodiment, it is to be clearly understood by those skilled in the art that the invention is not limited thereto but rather is intended to be interpreted only in accordance with the following claims.

The embodiments of the invention in which an exclusive property or privilege are claimed as defined as follows:

1. An archery sight for use with a bow, said archery sight comprising:

a mounting plate, said mounting plate having opposing parallel surfaces;

a crosshair frame, said crosshair frame having a longitudinal dimension and a transverse dimension, said crosshair frame including a first and a second elongate side wall lying along said longitudinal dimension of said frame in generally parallel spaced relation to one another, each said side wall having a first and second end, said first side wall having a slot formed therethrough along its elongate dimension, an elongate top wall attached to said first ends of said side walls and an elongate bottom wall attached to said second ends of said side walls, said side walls and said top wall and said bottom wall in assembly defining an aperture;

means for mounting said crosshair frame on said mounting plate such that a plane defined by the transverse and longitudinal dimensions of said crosshair frame is substantially normal to one surface of said mounting plate;

a plurality of first wires mounted in said crosshair frame substantially contained within said aperture and extending across said aperture in substantially parallel spaced relation to each other and substantially parallel to the transverse dimension of said crosshair frame;

a second wire mounted in said crosshair frame orthogonal to and intersecting said plurality of first wires, said second wire lying in the plane defined by said longitudinal and transverse dimensions of said crosshair frame;

clamping means attached to a first end of each of said first wires adjacent said first side wall for releasably clamping said first side wall to attach said first wires to said frame, said clamping means including a T-nut attached to said first end of said first wire, said T-nut having a crossbar portion abutting a first surface of said first side wall and a shank portion extending into said slot, a threaded shaft having a first end and a second end, said first end threadably engaging said T-nut, a bushing affixed to the second end of said threaded shaft, means associated with said bushing for preventing said bushing from passing through said slot, said means being interposed between said bushing and a second surface of said first side wall so that said first side wall is clamped between said bushing and said T-nut.

2. The sight of claim 1 wherein said first wire is attached to said T-nut offset from the centerline of said threaded shaft.

3. The sight of claim 1 wherein said second side wall has a groove formed in a first surface of said second side wall along its elongate dimension adjacent said aperture to closely receive a second end of each of said first wires.

4. The sight of claim 1 further including means for varying the distance between said frame and said mounting plate.

5. The sight of claim 4 wherein said mounting plate is generally trapezoidal in shape, having first and second parallel sides and first and second nonparallel sides, said first parallel side being longer than said second parallel side;

wherein said mounting plate has a first tab portion extending from a first end of said first parallel side and a second tab portion extending from a second opposing end of said first parallel side, each of said first and second tab portions having a mounting aperture formed therethrough;

wherein further said frame has a first threaded shaft extending from a first end of said side wall and a second threaded shaft extending from a second opposing end of said first side wall, said first and second shafts generally parallel to said top and bottom walls of said frame, said first threaded shaft engaging said mounting aperture in said first tab portion and said second mounting shaft engaging said mounting aperture in said second tab portion; and, further including a first pair of nuts threadably engaging said first shaft such that one of said nuts abuts a first surface of said first tab portion and the other of said nuts abuts a second surface of said first tab portion, thereby clamping said first tab portion, and a second pair of nuts threadably engaging said second shaft such that one of said nuts abuts a first surface of said second tab portion and the other of said nuts abuts a second surface of said second tab portion, thereby clamping said second tab portion.

6. An archery sight for use with a bow, said archery sight comprising:

a mounting plate for mounting the sight to the bow, said mounting plate haveing a first tab portion and a second tab portion extending therefrom, said first and second tab portions being spaced from one another, and each of said first and second tab portions having a mounting aperture formed therethrough;

a crosshair frame spaced from said mounting plate, said crosshair frame having a first shaft and a second shaft extending therefrom, said first and second shafts being spaced from one another, said first shaft engaging and extending through said mounting aperture in said first tab portion and said second shaft engaging and extending through said mounting aperture in said second tab portion;

a plurality of first wires mounted on said crosshair frame in substantially parallel spaced relation to each other to provide range markers;

a second wire mounted on said crosshair frame orthogonal to and intersecting said plurality of first wires to provide a windage marker; and first means for varying the amount of the extension of said first and second shafts through said mounting apertures so as to vary the spacing between the mounting plate and the frame to provide a windage adjustment.

7. The sight of claim 6 wherein said first and second shafts are threaded and said first means includes a first pair of nuts threadably engaging said first shaft such that one of said nuts abuts a first surface of said first tab portion and the other of said nuts abuts a second surface of said first tab portion, thereby clamping said first tab portion, and a second pair of nuts threadably engaging said second shaft such that one of said nuts abuts a first surface of said second tab portion and the other of said nuts abuts a second surface of said second tab portion, thereby clamping said second tab portion.

8. The sight of claim 6 further including means for varying the spacing of said first wires in relation to one another.

* * * * *

UNITED STATES PATENT AND TRADEMARK OFFICE

CERTIFICATE OF CORRECTION

PATENT NO. : 4,136,462

DATED : January 30, 1979

INVENTOR(S) : Topel

It is certified that error appears in the above-identified patent and that said Letters Patent are hereby corrected as shown below:

In the Abstract, line 2, delete "plurlity" and insert —plurality—.

Column 3, line 22, delete "') a" and insert —42a—.

Column 3, line 23, after "42a" insert —and a—.

Column 4, line 12, delete "busing" and insert —bushing—.

Column 5, line 50, delete "123" and insert —23—.

Column 5, line 66, delete "adjustement" and insert —adjustment—.

Column 6, line 4, delete "elemment" and insert —element—.

Column 6, line 9, delete "extapolate" and insert —extrapolate—.

Column 8, line 12, delete "haveing" and insert —having—.

Signed and Sealed this

*Twelfth* Day of *June 1979*

[SEAL]

*Attest:*

RUTH C. MASON
*Attesting Officer*

DONALD W. BANNER
*Commissioner of Patents and Trademarks*